US009312628B2

(12) United States Patent
Lappoehn

(10) Patent No.: US 9,312,628 B2
(45) Date of Patent: Apr. 12, 2016

(54) ELECTRICAL PLUG CONNECTOR

(75) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 13/882,240

(22) PCT Filed: Nov. 3, 2011

(86) PCT No.: PCT/DE2011/001926

§ 371 (c)(1),
(2), (4) Date: Apr. 29, 2013

(87) PCT Pub. No.: WO2012/059086

PCT Pub. Date: May 10, 2012

(65) Prior Publication Data

US 2013/0217259 A1 Aug. 22, 2013

(30) Foreign Application Priority Data

Nov. 5, 2010 (DE) ..... 20 2010 015 046 U

(51) Int. Cl.

| | |
|---|---|
| ***H01R 13/60*** | (2006.01) |
| ***H01R 13/58*** | (2006.01) |
| ***H01R 12/71*** | (2011.01) |
| *H01R 12/70* | (2011.01) |
| *H01R 13/645* | (2006.01) |

(52) U.S. Cl.

CPC ..... *H01R 13/58* (2013.01); *H01R 12/707* (2013.01); *H01R 12/716* (2013.01); *H01R 12/7005* (2013.01); *H01R 13/6456* (2013.01)

(58) Field of Classification Search

CPC .... H01R 12/707; H01R 12/716; H01R 12/57; H01R 12/7005; H01R 12/79; H01R 12/7011

USPC ..... 439/570, 552–554

See application file for complete search history.

(56) References Cited

U.S. PATENT DOCUMENTS 5,120,256 A * 6/1992 Walden ..... 439/553
5,356,300 A * 10/1994 Costello et al. ..... 439/101

(Continued)

FOREIGN PATENT DOCUMENTS

CN 1187057 A 7/1998
JP 11-167955 6/1999

(Continued)

OTHER PUBLICATIONS

Erni, 1.27 mm SMC Board-on IDC Cable Connectors, Brochure D074497 Feb. 2008, Edition 3. In German and English.

(Continued)

*Primary Examiner* — Xuong Chung Trans
(74) *Attorney, Agent, or Firm* — Collard & Roe, P.C.

(57) ABSTRACT

The invention relates to a plug comprising a plurality of contact elements located in a plug housing and strain relief elements (200, 200') arranged on the housing (110, 310), wherein both contact elements and strain relief elements can be fixed to a printed circuit board (10) using SMT technology. The invention is characterized in that the strain relief elements (200, 200') are sheet metal elements that can be fixed to parts of the plug housing and are bent essentially at a right angle on the side facing the printed circuit board (10), thereby forming a bearing surface (220, 220') for SMT attach.

3 Claims, 5 Drawing Sheets

(56) References Cited

U.S. PATENT DOCUMENTS

| | | | | | |
|---|---|---|---|---|---|
| 5,466,171 | A | * | 11/1995 | Bixler et al. | 439/378 |
| 5,885,088 | A | * | 3/1999 | Brennan et al. | 439/680 |
| 5,961,347 | A | * | 10/1999 | Hsu | 439/570 |
| 6,007,352 | A | * | 12/1999 | Azuma et al. | 439/108 |
| 6,053,767 | A | * | 4/2000 | Copper et al. | 439/567 |
| 6,089,883 | A | | 7/2000 | McHugh et al. | |
| 6,645,005 | B2 | * | 11/2003 | Wu | 439/563 |
| 7,887,350 | B2 | * | 2/2011 | Fukazawa et al. | 439/247 |
| 2003/0100211 | A1 | | 5/2003 | Wu | |
| 2007/0049116 | A1 | | 3/2007 | Lappoehn | |
| 2007/0155227 | A1 | | 7/2007 | Ishizuka et al. | |
| 2008/0026622 | A1 | | 1/2008 | Tomizu et al. | |
| 2008/0085616 | A1 | | 4/2008 | Hirai et al. | |
| 2010/0055952 | A1 | | 3/2010 | Fukazawa et al. | |

FOREIGN PATENT DOCUMENTS

| | | | |
|---|---|---|---|
| JP | 11-167955 | A1 | 6/1999 |
| JP | 2007-042468 | A | 2/2007 |
| JP | 2007-066890 | A | 3/2007 |
| JP | 2010-055852 | A | 3/2010 |
| WO | WO 02/097926 | | 12/2002 |
| WO | 2008/096678 | A1 | 8/2008 |

OTHER PUBLICATIONS

International Search Report of PCT/DE2011/001926, date of mailing Jul. 18, 2012.

Japanese Office Action in JP 2013-536998, dated Feb. 24, 2015, with English translation.

European Office Action in EP 11 817 209.7, Dated Aug. 31, 2015, with English translation of relevant parts.

* cited by examiner

ELECTRICAL PLUG CONNECTOR

CROSS REFERENCE TO RELATED APPLICATIONS

This application is the National Stage of PCT/DE2011/001926 filed on Nov. 3, 2011, which claims priority under 35 U.S.C. §119 of German Application No. 20 2010 015 046.9 filed on Nov. 5, 2010, the disclosure of which is incorporated by reference. The international application under PCT article 21(2) was not published in English.

The invention relates to a plug comprising a plurality of contact elements arranged in a plug housing and strain relief elements arranged on the housing, wherein both contact elements and strain relief elements can be fixed to a printed circuit board using SMT technology.

DESCRIPTION OF THE PRIOR ART

Such plugs are marketed by the applicant under the product designation SMC plug connectors and are shown for example in the brochure D074497 02/08 Edition 3 of the applicant, which can be downloaded from the applicant's website under http://ww.erni.com/db/pdf/smc/ERNI-SMC-Board-on-d.pdf. In these plug connectors, the strain relief elements are respectively fixed laterally transversely to the plug-in direction and substantially in extension of the fastening elements which are arranged on the longitudinal sides of the plug housing and are connected via plastic webs with the plug housing. The strain relief elements are punched sheet metal parts which are fixed to the fastening elements. The sheet metal elements comprise supporting surfaces for SMT fastening on the side facing the printed circuit board. These supporting surfaces respectively protrude laterally beyond the narrow sides of the housing.

These plugs comprise male multipoint connectors and female multipoint connectors which respectively comprise such strain relief elements. In the mated state, the plug-in process will be substantially limited by the thickness of the laterally protruding plastic webs. Within the terms of a high level of mating reliability, i.e. within the terms of maximum mutual insertion, it is now desirable that the two plug connector parts (i.e. male multipoint connector and female multipoint connector) are inserted into each other as deeply as possible. For this reason the plastic web would have to be provided the thinnest possible configuration because the depth of mutual insertion of the two plug connector parts is limited by the thickness of the plastic web. However, this is not possible within the terms of optimal strain relief because the aforementioned strain relief elements are fixed to the fastening projections, which on their part are integrally formed on the web. A thin plastic web, however, does not have the desired stability.

The invention is therefore based on the object of further developing such a plug in the respect that maximum mating reliability is ensured on the one hand (i.e. maximum mutual insertion of male multipoint connector and female multipoint connector) and optimal strain relief is ensured on the other hand.

ADVANTAGES OF THE INVENTION

Summary of the Invention

This object is achieved by a plug of the kind described above in such a way that the strain relief elements are sheet metal elements that can be fixed to parts of the plug housing and are bent off substantially at a right angle on the side facing the printed circuit board, thereby forming a supporting surface for the SMT fastening. It is the fundamental idea of the invention to completely omit the laterally protruding plastic webs which are used for fastening the strain relief elements and to arrange the strain relief elements as sheet metal parts which can be fastened directly to a part of the plug housing and are bent off on the side facing the printed circuit board by forming a supporting surface. As a result, fastening devices which are integrally formed on the laterally protruding plastic webs can be omitted completely. It is rather the sheet metal elements themselves that form the strain relief, wherein the bent-off regions which form the supporting surface can be provided with a substantially thinner configuration as a result of the higher stability of sheet metal in comparison with plastic. As a result, maximum mating and therefore a very high level of mating reliability is enabled, i.e. maximum mutual insertion of the plug contact elements.

Advantageous developments and improvements of the plug stated in the independent claim 1 are enabled by the measures stated in the dependent claims.

An advantageous embodiment provides that the sheet metal elements can be fixed to webs which are simultaneously used for reverse polarity protection. These webs enable an especially stable fixing of the sheet metal elements to the plug housing which will also withstand high tensile forces. The webs are simultaneously used for reverse polarity protection.

It is provided in an embodiment that the webs protrude beyond the plug housing both in the plug-in direction and also transversely to the plug-in direction and are therefore arranged in a substantially thicker and more massive configuration than the housing walls. This not only increases the stability of the fastening of the sheet metal elements, but also increases the sturdiness of the reverse polarity protection.

It is provided in another embodiment that the webs protrude into the interior of the housing and are provided with a thicker and more massive configuration than the housing wall. This also leads to an increase in the stability of the fastening of the sheet metal elements. At the same time, the webs are used as sturdy reverse polarity protection.

The sheet metal elements can principally be fixed to the webs in numerous ways. Adhesive connections, press connections or the like can principally be considered.

An especially advantageous embodiment provides that the sheet metal elements can be fixed to the webs by latching connections. Such latching elements not only enable simple mounting but also simple production, e.g. by punching the sheet metal elements.

An especially preferred embodiment provides that the sheet metal elements comprise four latching connections which are subdivided into two groups of two latching elements each, with the first group being arranged as close as possible to the printed circuit board and the second group as close as possible to the upper side of the plug. This also increases the stability of the plug fixed to a printed circuit board with respect to a torque exerted on the plug. The sturdiness of strain relief will also be increased substantially in this way.

Preferably, the sheet metal elements that are bent off at a right angle form a rectangular supporting surface which extends perpendicularly to the plug-in direction and parallel to the printed circuit board by protruding beyond the sides of the housing. This configuration allows fixing the strain relief elements over a large area, with the supporting surface—other than in the state of the art—not being interrupted but arranged in a continuous way.

The sheet metal elements are preferably punched parts which can be produced in a very rapid and precise way especially in mass production. Only bending processes are required after the punching process, i.e. the arrangement of the supporting surfaces arranged at a right angle and the arrangement of the latching elements.

BRIEF DESCRIPTION OF THE DRAWINGS

Embodiments of the invention are shown in the drawings and are explained in closer detail in the description below, wherein the drawings show as follows.

DETAILED DESCRIPTION OF THE PREFERRED EMBODIMENTS

Figure 1:
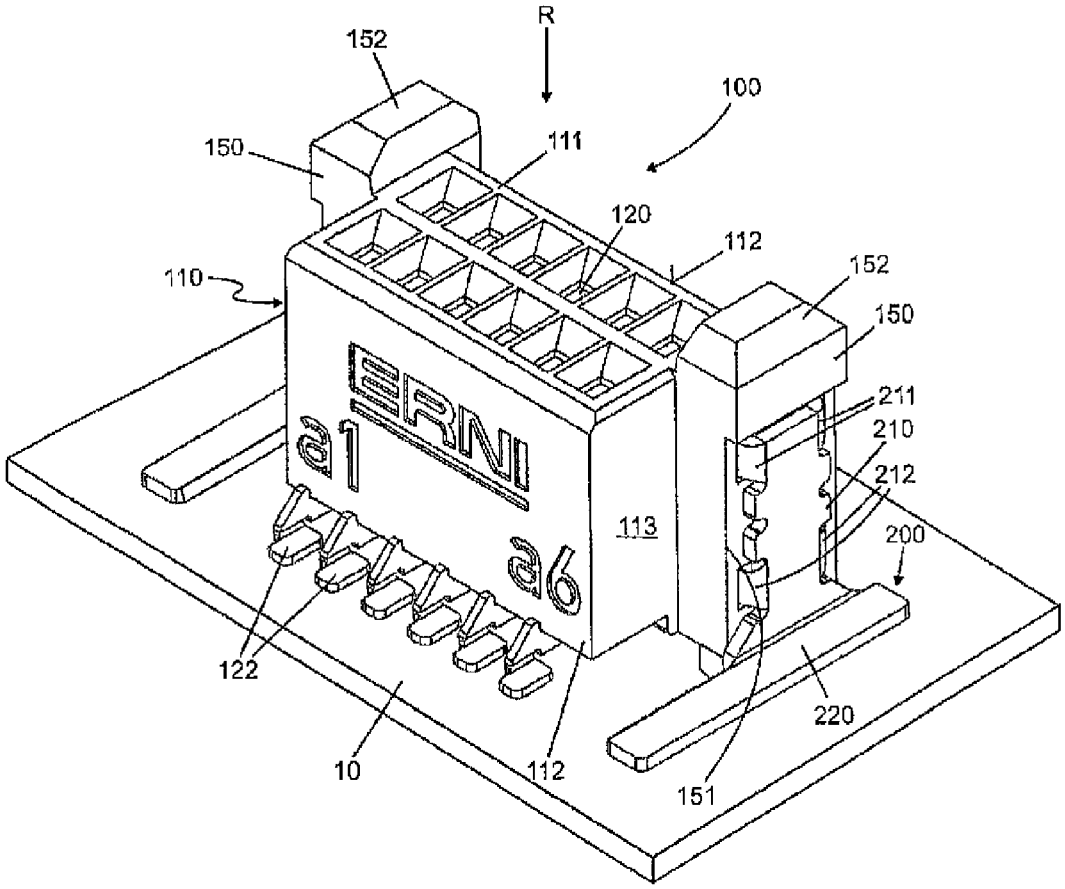
FIG. 1 shows an isometric view of a plug in accordance with the invention which is arranged on a printed circuit board and as a female multipoint connector.

Plugs will be explained below by reference to the drawings, which plugs can be arranged both as a female multipoint connector (cf. FIG. 1 and FIG. 2) and also as a male multipoint connector (cf. FIG. 3). A female multipoint connector, which is designated in its entirety with reference numeral 100, comprises a housing 110 in which spring contact elements (not shown) are arranged in the known manner. The housing 110 comprises openings 120 on its upper side 111 into which blade contacts can be inserted, which will be described below in closer detail. The spring contact elements comprise SMT solder pads 122 on their bottom side, which solder pads can protrude for example beyond the side areas 112 and are arranged on a printed circuit board 10. Webs are arranged laterally on the housing 110, which protrude beyond the housing both in the mating direction (designated with arrow R in FIG. 1) and perpendicularly to the mating direction beyond the side surfaces 112 and 113 which delimit the housing. The webs 150 comprise projections 152 which are shaped in the manner of truncated pyramids and which are provided for insertion into recesses in a part of the housing (FIG. 3) arranged as a male multipoint connector. The webs 150 are used on the one hand for reverse polarity protection and on the other hand strain relief elements 200 can be fixed to them which are arranged as sheet metal parts. The sheet metal parts have a substantially L-shaped contour, comprising a part 210 extending in the vertical direction and a sheet metal part 220 which is bent off therefrom at a right angle and extends parallel to the printed circuit board 10.

The sheet metal part 210 extending in the vertical direction comprises four latching elements 211, 212, of which one group of two latching elements 211 is arranged as close as possible adjacent to the upper side 111 of the housing 110 of the plug connector 100 and a further pair of latching elements 212 is arranged as close as possible to the bent-off sheet metal part 220 and therefore the printed circuit board 10. This arrangement of four latching elements in such a way that two respective pairs have the greatest possible distance from one another in the mating direction ensures secure fastening of the strain relief element 200 arranged as a sheet metal part and especially also sufficiently large sturdiness for example against breaking off of the plug 100 fixed to the printed circuit board by exerting a torque on said plug 100.

The bent-off part 220 of the strain relief element 200 is used as a supporting surface for SMT fastening to the printed circuit board. Said bent-off part 220 has a substantially rectangular shape, wherein it protrudes beyond the narrow side 113 transversely to the mating direction in order to provide the largest possible supporting surface. As a result, the solder pads 122 which are soldered onto the printed circuit board are effectively strain-relieved and therefore inadvertent interruption of the contacts of one or several of the solder pads 122 as a result of high tensile loading is prevented.

As is shown in FIG. 1, the sheet metal element can be fixed to the web 150 in a recess 151 provided for this purpose. This is not mandatory however. Principally, the strain relief element 200 can also be fixed on the outside to the web, i.e. without recess. A recess 151 as shown in FIG. 1 allows an especially compact configuration however.

Figure 2:
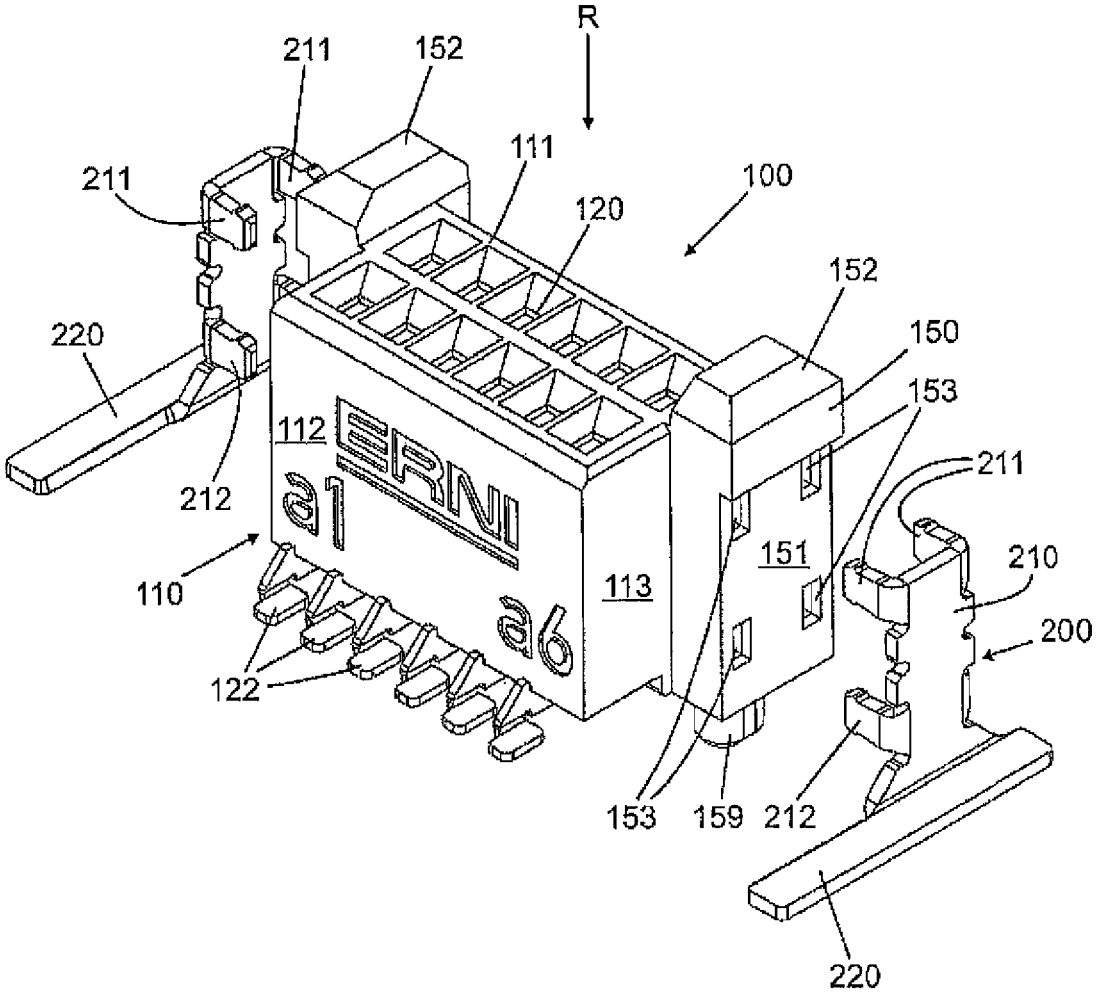
FIG. 2 shows the plug illustrated in FIG. 1 prior to mounting the sheet metal elements used for strain relief.

FIG. 2 shows the plug connector illustrated in FIG. 1 shortly before the fixing of the strain relief elements 200. The same elements are provided with the same reference numerals as in FIG. 1. The latching openings 153 can be recognized in the dismounted state, into which the latching elements 211, 212 of the strain relief element 200 will engage. The strain relief elements 200 are punched out of a sheet metal part, wherein the punching process merely needs to be followed by bending processes, i.e. the rectangular bending of the part 220 and the bending of the latching elements 211, 212. The fixing of the strain relief elements 200 occurs by latching in the latching openings 153 in the webs 150.

Figure 3:
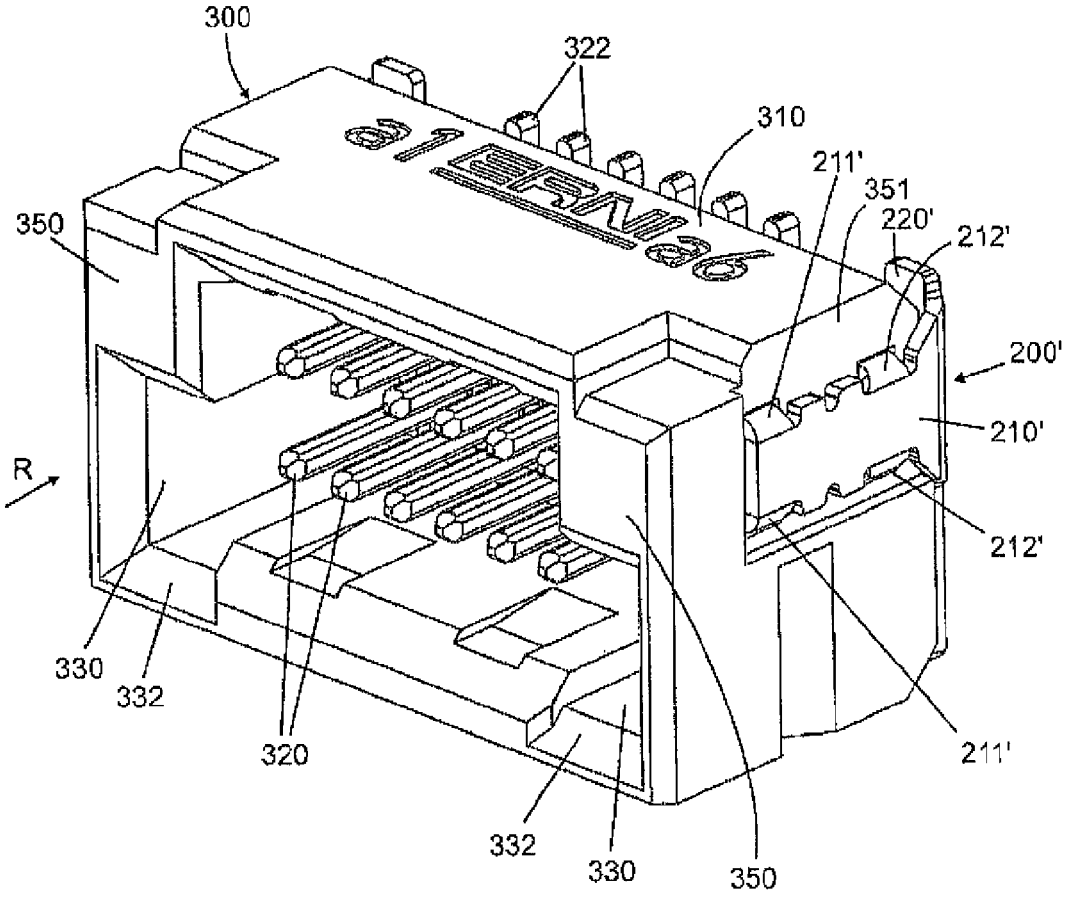
FIG. 3 shows an isometric view of a plug connector in accordance with the invention which is arranged as a male multipoint connector.

FIG. 3 shows a plug connector 300 which is arranged as a male multipoint connector. Blade contacts 320 are arranged in the plug. Recesses 330 are respectively provided on either side of the blade contacts 320, into which the aforementioned webs 150 can be inserted. For this purpose, the recesses 330 comprise inclined receiving openings 332 which are adjusted to the upper sides 152 of the webs, which sides are shaped in the manner of truncated pyramids. SMT pads 322 of the blade contacts 320 are provided which respectively face a printed circuit board (not shown).

Strain relief elements 200' are also provided in the plug shown in FIG. 3, which strain relief elements are arranged as sheet metal parts and comprise a part 210', which extends substantially in the mating direction R and which can be fastened by latching elements 211', 212' to a web 350, which, however, in contrast to the female multipoint connector protrudes into the interior of the plug housing, and a part 220' which is bent off in a substantially rectangular way. A recess 351 is also provided in this case too, so that the strain relief element 200' will not protrude laterally beyond the plug housing. The webs 350 are used for reverse polarity protection in this case too. They are used simultaneously for optimal fastening of the strain relief elements 200' by means of the latching connections. The webs 350 enable a fixing by means of the latching elements 211', 212' which otherwise could protrude into the interior of the plug housing 310. The bent-off part 220' is herein bent off in such a way that it does not protrude laterally beyond the plug housing, but is directed inwardly facing the SMT pads 322 of the blade contacts 320. This is not mandatory however.

Rather, the bent-off part 220' can also be bent off to the outside, as described above in conjunction with FIG. 1 and FIG. 2. The solution shown in FIG. 3 provides an especially compact configuration of the plug. The strain relief, which is formed by the rectangular area 220' of the strain relief element 200', protrudes slightly beyond the lateral boundary surfaces of the plug.

Figure 4:
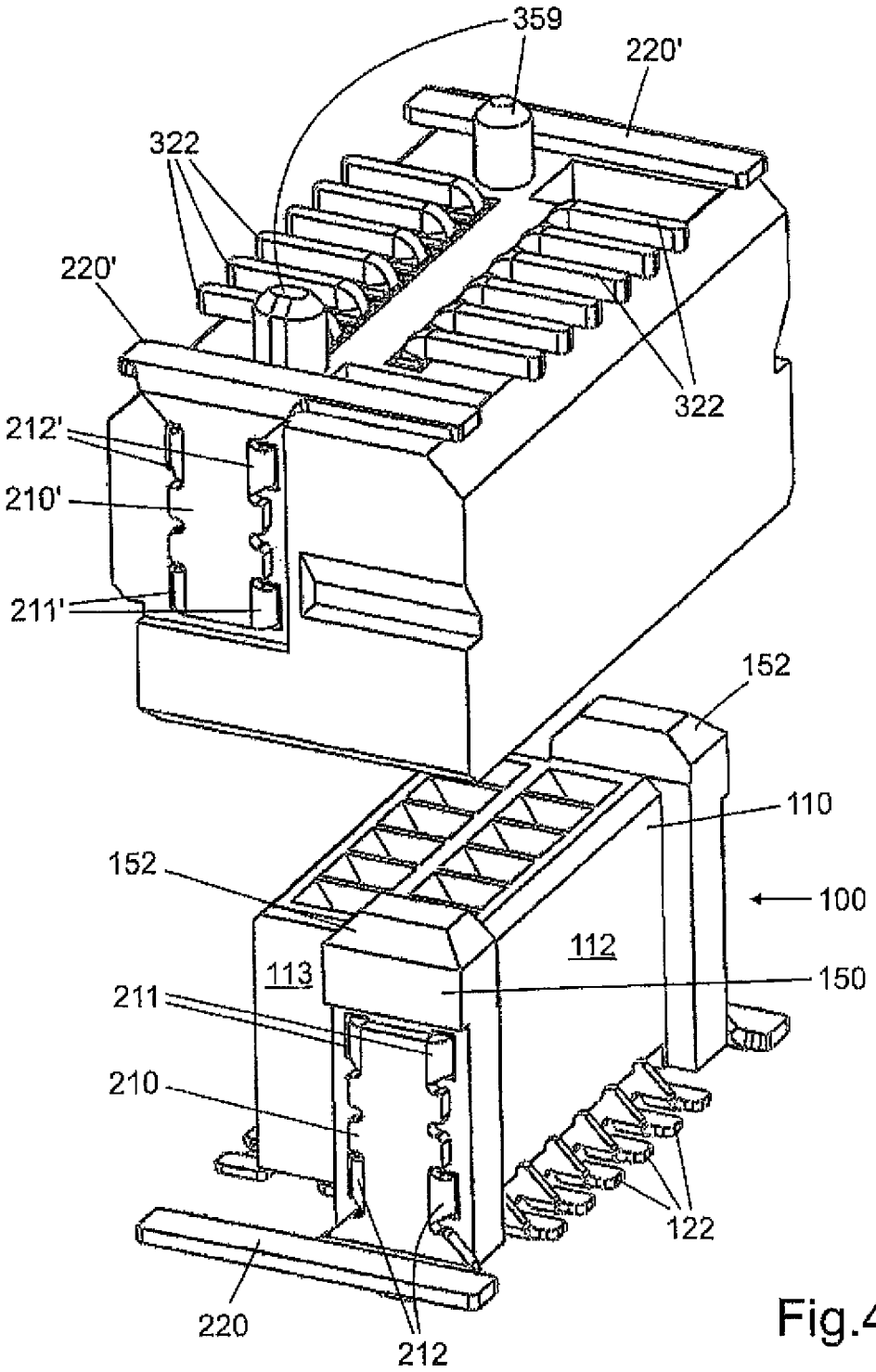
FIG. 4 shows two plug connectors in accordance with the invention, a female multipoint connector and a male multipoint connector, prior to mating.

FIG. 4 shows a female multipoint connector shown in FIG. 1 and FIG. 2 of a plug in accordance with the invention and a male multipoint connector situated above of a plug in accordance with the invention shortly before mating. FIG. 4 also shows the centering pins 359 which engage into respectively arranged openings in the printed circuit board (not shown). These centering pins are also arranged in the respective manner in the female multipoint connector and are provided there with the reference numeral 159 (cf. FIG. 2).

FIG. 4 also shows in closer detail that the webs 150 protrude beyond the lateral boundary surfaces 112, 113 of the plug housing 110. This is used for reverse polarity protection. Furthermore, this improves the stability of the plug, especially also the stability of the strain relief provided by the strain relief elements 200 arranged on the webs 150.

Figure 5:
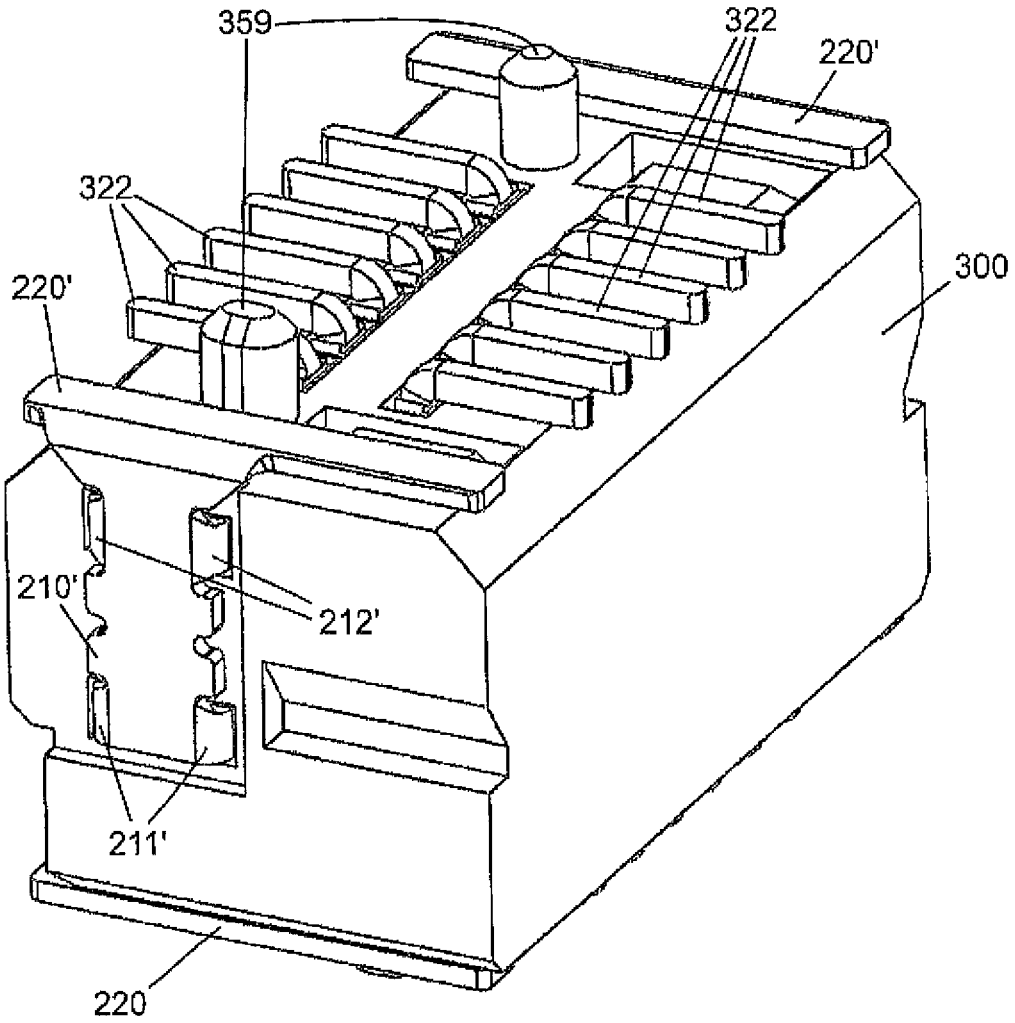
FIG. 5 shows a male multipoint connector and a female multipoint connector in accordance with the invention after mating.

FIG. 5 finally shows the mated state of male multipoint connector and female multipoint connector. Maximum mating of male and female multipoint connector is enabled by the arrangement of the strain relief elements 200, 200' in accordance with the invention. The male multipoint connector 300 can be inserted to such an extent into the female multipoint connector 100 that its upper side rests on the laterally protruding, bent-off part 220 of the strain relief elements 200. Since this protruding part 220 consists of a bent-off sheet metal part which can be provided with a very thin configuration without consequently impairing stability, maximum mating of male and female multipoint connector is enabled and high mating reliability in combination with simultaneously optimal strain relief of both parts of the plug is consequently ensured, i.e. male multipoint connector and female multipoint connector, because the SMT area is large which is formed by the bent-off part 220.

The invention claimed is:

1. Plug comprising a plurality of contact elements arranged in a plug housing and strain relief elements arranged on the housing, wherein the contact elements and the strain relief elements can be fixed to a printed circuit board using SMT technology, wherein the strain relief elements are sheet metal elements that can be fixed to parts of the plug housing and are bent off substantially at a right angle on the side facing the printed circuit board, thereby forming a supporting surface for SMT fastening, wherein the sheet metal elements are fastened to webs used for reverse polarity protection, wherein the webs protrude beyond the plug housing both in the mating direction and also transversely to the mating direction, wherein the sheet metal elements can be fixed by latching connections to the webs, wherein the sheet metal elements comprise four latching connections, which are subdivided into two groups of two latching elements each, and wherein the first group is arranged as close as possible to the upper side of the plug and the second group as close as possible to the printed circuit board.

2. Plug according to claim 1, wherein the sheet metal elements which are bent off at a right angle and form the strain relief elements form a rectangular supporting surface which extends perpendicularly to the mating direction and parallel to the printed circuit board protruding beyond the sides of the housing.

3. Plug according to claim 1, wherein the sheet metal elements forming the strain relief elements are bent punched parts.

* * * * *